US006189613B1

(12) United States Patent
Chachula et al.

(10) Patent No.: US 6,189,613 B1
(45) Date of Patent: Feb. 20, 2001

(54) DOWNHOLE OIL/WATER SEPARATION SYSTEM WITH SOLIDS SEPARATION

(75) Inventors: Ryan C. Chachula, Calgary; Sandeep C. Solanki, Edmonton, both of (CA)

(73) Assignee: Pan Canadian Petroleum Limited, Alberta (CA)

( * ) Notice: Under 35 U.S.C. 154(b), the term of this patent shall be extended for 0 days.

(21) Appl. No.: 09/405,138

(22) Filed: Sep. 24, 1999

(30) Foreign Application Priority Data

Sep. 25, 1998 (CA) ..... 2247838

(51) Int. Cl.[7] ..... E21B 43/34
(52) U.S. Cl. ..... 166/265; 166/369; 166/105.5
(58) Field of Search ..... 166/265, 105, 166/369, 305.1, 105.5, 106, 313

(56) References Cited

U.S. PATENT DOCUMENTS

| | | | | |
|---|---|---|---|---|
| 4,241,787 | | 12/1980 | Price . | |
| 4,296,810 | | 10/1981 | Price . | |
| 4,688,650 | | 8/1987 | Hayatdavoudi et al. . | |
| 4,702,837 | | 10/1987 | Lecoffre et al. . | |
| 4,738,779 | | 4/1988 | Carroll et al. . | |
| 4,793,408 | | 12/1988 | Miffre . | |
| 4,805,697 | | 2/1989 | Fouillout et al. . | |
| 5,296,153 | | 3/1994 | Peachey . | |
| 5,456,837 | | 10/1995 | Peachey . | |
| 5,693,225 | | 12/1997 | Lee . | |
| 5,711,374 | | 1/1998 | Kjos . | |
| 5,762,149 | | 6/1998 | Donovan et al. . | |
| 5,794,697 | | 8/1998 | Wolflick et al. . | |
| 5,996,690 | * | 12/1999 | Shaw et al. | 166/250.01 |
| 6,026,901 | * | 2/2000 | Brady et al. | 166/265 |
| 6,080,312 | * | 6/2000 | Bowers et al. | 210/512.2 |
| 6,082,452 | * | 7/2000 | Shaw et al. | 166/105.5 |

FOREIGN PATENT DOCUMENTS

| | | |
|---|---|---|
| 0022357 A1 | 1/1981 | (EP) . |
| 2 308 995 | 7/1997 | (GB) . |
| WO 86/03143 | 6/1986 | (WO) . |
| WO 93/09875 | 5/1993 | (WO) . |
| WO 94/13930 | 6/1994 | (WO) . |
| WO 94/25729 | 11/1994 | (WO) . |
| WO 95/09970 | 4/1995 | (WO) . |
| WO 97/11254 | 3/1997 | (WO) . |

OTHER PUBLICATIONS

B. R. Peachey, S. Solanki, T. Zahacy, K. Piers, "Downhole Oil/Water Separation Moves Into High Gear," Presented at the 48th Annual Technical Meeting of The Petroleum Society, Paper 97–91, Jun. 1997.

T. L. Danyluk and R.C. Chachula, S.C. Solanki, "Field Trial of the First Desanding System for Downhole Oil/Water Separation in a Heavy–Oil Application," Presented at the 1998 SPE (Society of Petroleum Engineers) Annual Technical Conference and Exhibition, 1998.

* cited by examiner

*Primary Examiner*—Frank Tsay
(74) *Attorney, Agent, or Firm*—Morgan, Lewis & Bockius LLP

(57) ABSTRACT

A downhole oil/water separation apparatus and process which separates solids from total production fluid prior to oil/water separation is disclosed. Production fluid is passed to a downhole solid/liquid cyclone which separates the fluid into a solids enriched stream and an oil/water stream. The oil is then commingled with the solids enriched stream and brought to surface. The water is reinjected downhole. The method effectively removes solids from the disposal fluid and thus avoids injectivity impairment caused by solids plugging.

14 Claims, 12 Drawing Sheets

DOWNHOLE OIL/WATER SEPARATION SYSTEM WITH SOLIDS SEPARATION

This invention relates to a downhole oil/water separation process which separates solids to remove them from the disposal water stream.

BACKGROUND OF THE INVENTION

Many oil wells experience high water production. High water production is undesirable because it necessitates artificial lift systems which must accommodate the volume of water produced as well as water handling facilities at surface. These requirements add significantly to the operational and capital expenditures associated with production. In some circumstances, the production of wells and fields have been suspended or abandoned with significant volumes of oil left in the ground as a result of the poor economics resulting from excessive water production.

Downhole oil/water separation ("DHOWS") systems have been developed to contend with increased water production. Such systems incorporate the use of downhole liquid/liquid cyclones to separate the oil from the water. The separated oil is lifted to surface and the water is reinjected downhole. Unfortunately, the application of DHOWS systems in these wells is complicated by the inherent production of solids, such as sand, with the oil. The solids that are produced tend to remain in the disposal water stream which is reinjected downhole. Depending on the solids volume and well conditions, the solids may invade and plug the disposal zone or they may accumulate in the well bore. In either case, the situation ultimately leads to a reduction in injectivity which reduces the effectiveness or precludes the further use of a DHOWS system.

Attempts have been made to remove sand from the disposal water stream. One such method is disclosed in International PCT Application No. GB96/02282 published as WO 97/12254 on Mar. 17, 1997. According to that method, a liquid/liquid cyclone may be used to separate the production fluid into an oil enriched stream and a water enriched stream. The oil enriched stream is transported to the surface and the water enriched stream proceeds to a solid/liquid cyclone where the water is separated from the sand and then transported to a downhole disposal site. While this method does provide a means for removing solids from production water before reinjecting it downhole, the presence of solids in the liquid/liquid cyclone causes significant erosion of that apparatus and the geometry and plumbing of the system have been found unfavourable. In addition, a system which removes solids downstream of the liquid/liquid cyclone cannot be easily incorporated into existing commercially available DHOWS systems.

SUMMARY OF THE INVENTION

The present invention provides a method for removing solids from total production fluid prior to separating the oil from the water by means of a downhole oil/water separation system. Production fluid is passed to a downhole solid/liquid cyclone which separates the fluid into a solids enriched stream and an oil/water stream. The oil/water stream then enters a liquid/liquid cyclone which separates the oil from the water. The oil is then commingled with the solids enriched stream and brought to surface. The water is reinjected downhole. The method effectively removes solids from the disposal fluid and thus avoids injectivity impairment caused by solids plugging.

Thus in accordance with the present invention there is provided a method for separating oil well production fluid containing oil, water and solids comprising: transporting the production fluid to a downhole liquid/solid cyclone; separating the production fluid in the liquid/solid cyclone into a solids enriched stream at the cyclone underflow and a oil and water enriched stream at the cyclone overflow; transporting the oil and water enriched stream to a liquid/liquid cyclone; separating the oil and water enriched stream in the liquid/liquid cyclone into an oil enriched stream at the cyclone overflow and a water enriched stream at the cyclone underflow; transporting the water enriched stream to a downhole disposal site; and transporting the oil enriched stream and the solids enriched stream to surface.

In accordance with another aspect of the present invention, there is provided an apparatus for separating oil well production fluid containing oil, water and solids downhole comprising: at least one liquid/solid cyclone adapted to receive the production fluid and separate it into a solid enriched stream at an underflow outlet of said cyclone and an oil and water enriched stream at the overflow outlet of said cyclone; at least one liquid/liquid cyclone adapted to receive the oil and water enriched stream from the overflow of the liquid/solid cyclone and separate said stream into an oil enriched stream at an overflow outlet of said cyclone and a water enriched stream at an underflow outlet of said outlet; a mixing means to mix the oil enriched stream with the solids enriched stream and produce an oil/solids stream; a first duct means to transport the oil enriched stream from the overflow outlet of the liquid/liquid cyclone to the mixing means; a second duct means to transport the solid enriched stream to the mixing means; and a third duct means to transport the oil/solids stream to surface.

DETAILED DESCRIPTION OF A PREFERRED EMBODIMENT OF THE INVENTION

Figure 1:
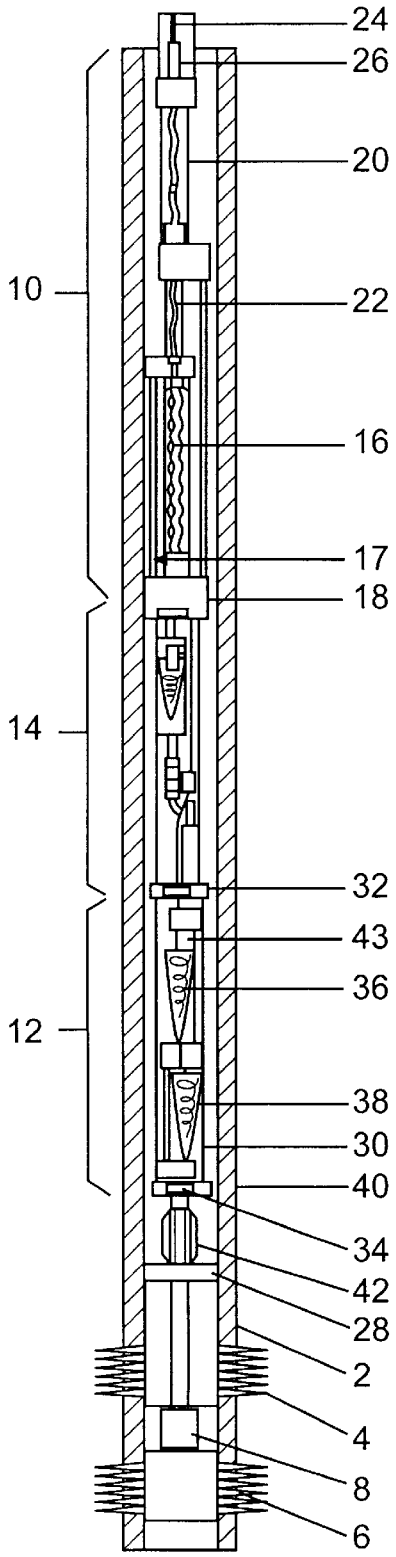
FIG. 1 is a longitudinal cross sectional view of the apparatus of the present invention.

With reference to FIG. 1, well bore casing 2 penetrates the production formation and is provided with production perforations 4 in the area of the production zone to allow for intake of production fluid. Injection perforations 6 in well casing 2 are provided in the area of the injection zone to allow for egress of injection fluid. The injection zone maybe above or below the production zone, depending on the well. Lower packer 8 isolates the production zone from the injection zone below. An upper packer (not shown) may be used if the characteristics of the particular well require it.

The well is equipped with artificial lift system 10 of progressing cavity pumps in the upper portion of well casing 2, liquid separation unit 12 in the lower portion of well casing 2, and solids separation unit 14 located between the pumps 10 and liquid separation system 12 and connected to each. Artificial lift system 10 consists of total production fluid pump 16 which is sized to pressurize the injection fluid for injection into the injection zone. Inlet screen 18 is adapted to receive total production fluid into pump 16. Total production feed line 17 extends from pump 16 to solids separation unit 14. Oil concentrate pump 20 is positioned above total production fluid pump 16 and is sized according to the well's inflow potential. Seal pump 22 provides a controlled-flow seal between total production fluid pump 16 and the concentrate production stream. Sucker rod 24 and rod on-off tool 26 are connected to the upper end of pump 20. No-turn tool 28 is installed above lower packer 8 to minimize tubing rotation caused by the operation of the progressing cavity pumps. Although the invention is described in association with the pumping system set out above, it is to be understood that the invention can be used with any artificial lift system which is compatible with a DHOWS system, for example, electric submersible pumps, beam pumps, and gas lift systems.

Liquid separation unit 12 is a conventional downhole water/oil separation system ("DHOWS"). The system is contained within housing 30 and has end units 32, 34. Liquid/liquid cyclones 36, 38 are positioned in parallel within housing 30. The number of cyclones required will vary depending on the inflow of the well. At the lower end of liquid separation unit 12, axial tubing 40 extends from the underflow outlets cyclones 36, 38 through end unit 34 and lower packer 8 into the area of the well adjacent injection perforations 6. Orifice 42, which regulates total system flow and injection and is sized for flow metering of the injection fluid, is incorporated into axial tubing 40. At the upper end of liquid separation unit 12, end unit 32 connects the housing 30 to solids separation unit 14. Oil concentrate line 43 extends from the overflow outlet of cyclones 36, 38 through end unit 32 into solids separation unit 14.

Figure 2:
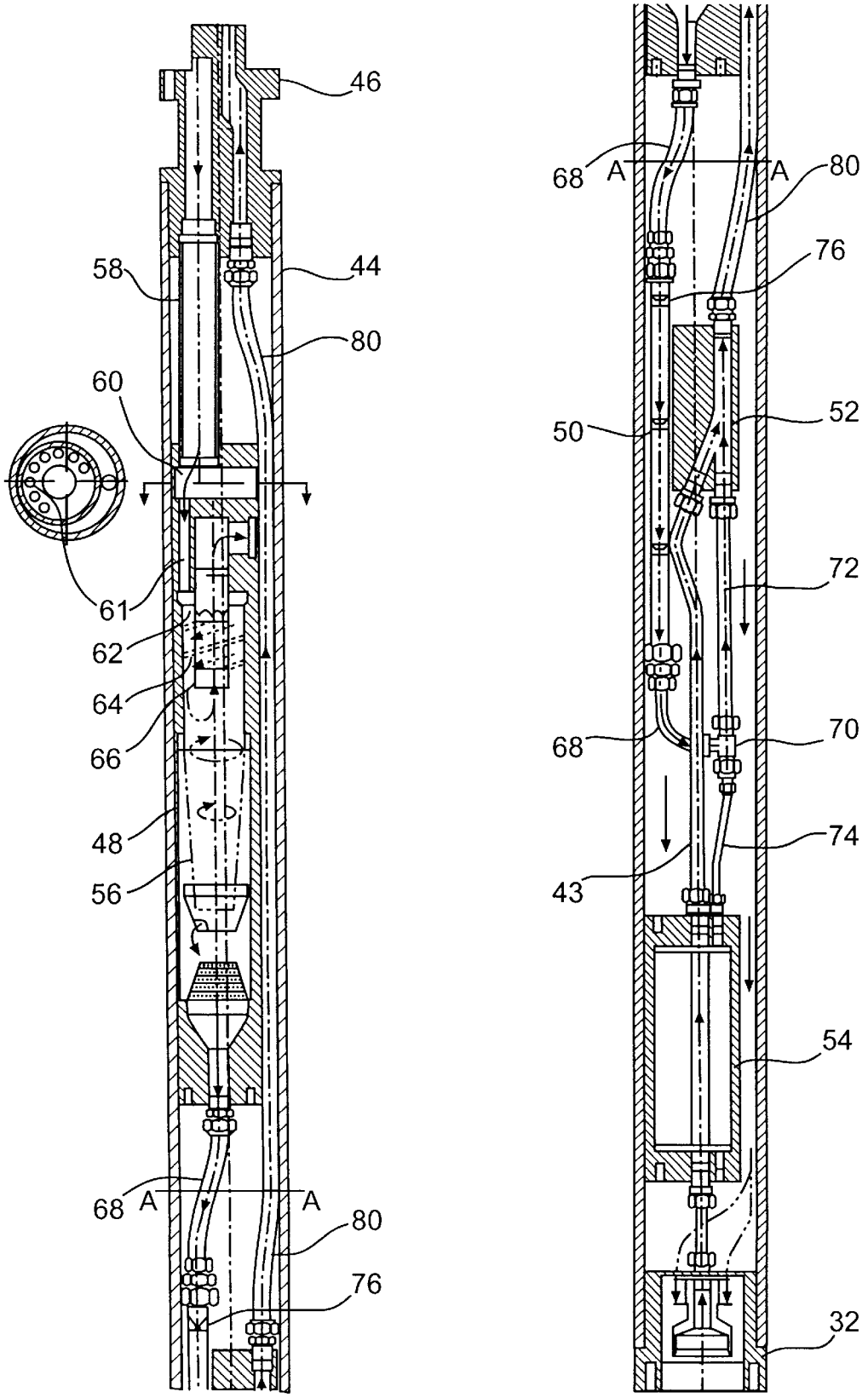
FIG. 2 is a longitudinal cross sectional view of the solids separation unit of the present invention.

Solids separation unit 14, which is shown in detail in FIG. 2 is contained within housing 44 and connects to end unit 32 below and to total production fluid pump 16 by means of flanged end unit 46 above. This configuration of end connection geometry and fluid flow paths advantageously allows for solids separator unit 14 to be retrofitted between the total fluid pump and the liquid separation unit in wells previously fitted with a DHOWS system or to be used as an add-on module for newly installed DHOWS systems. The components of solids separation unit 14 include solid/liquid cyclone 48, orifice gallery 76, mixer 52 and solids accumulator 54. Solid/liquid cyclone 48 is located in the upper portion of unit 14. As shown in FIGS. 1 and 2, the cyclone inlet assembly consists of axial tube 58 extending from one portion of total feed line 17 and which is connected to chamber 60 from which a plurality of axial flow passages 61 lead to inlet section annulus 62. Helical flow diverter 64 is located with inlet section annulus 62 surrounding vortex finder 66. Cone liner 56 is constructed of a material which resists abrasion and which is able to withstand the conditions of field application. A suitable metal or ceramic based material may be used and the preferred material is titanium.

In alternative embodiments, a swirl inducer or static auger, both of which are well known to those skilled in the art, may be used for solids/liquid separation instead of a cyclone separator.

Solids concentrate line 68 extends from the underflow outlet of cyclone 48 to solids tee 70. Branch line 72 branches from oil concentrate line 43 at mixer 52 and extends downwards to solids tee 70. Solids accumulator 54 is located beneath solids tee 70 and is connected to tee 70 by line 74. Tee 70 and accumulator 54 are positioned and the line geometry configured so that solids from solid concentrate line 68 and branch line 72 of oil concentrate line 43 drain into accumulator 54 during periods of shutdown.

Figure 13:
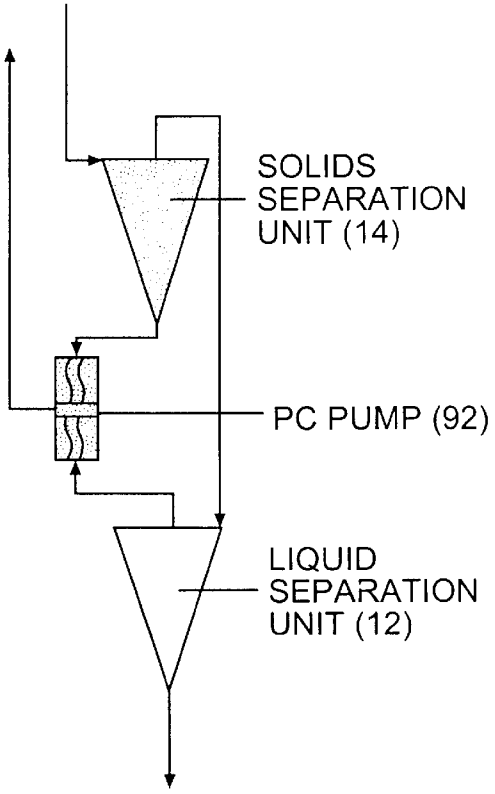
FIGS. 13 is a schematic diagram showing an alternative arrangement using a progressing cavity pump for mixing the solids concentrate and oil concentrate streams.
Figure 12:
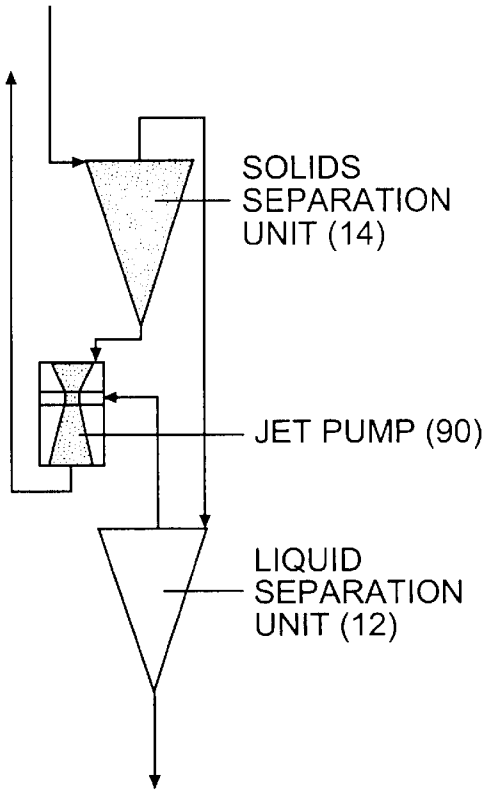
FIGS. 12 is a schematic diagram showing an alternative arrangement using a jet pump for mixing the solids concentrate and oil concentrate streams.
Figure 11:
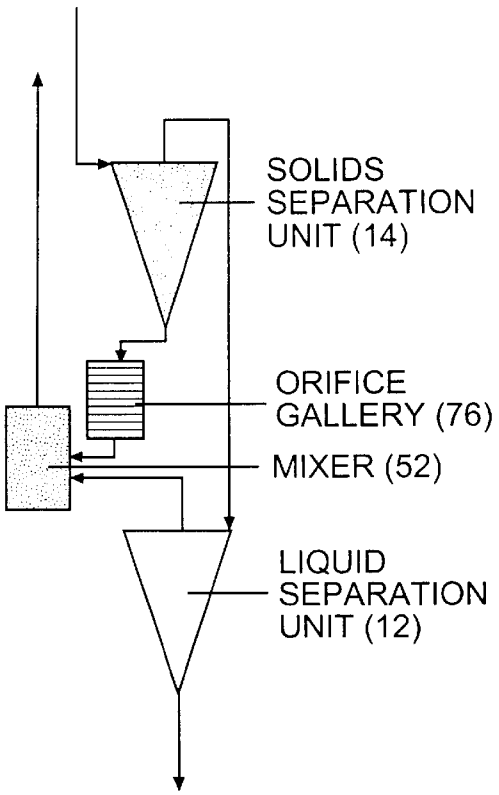
FIG. 11 is a schematic diagram showing an alternative arrangement using an orifice gallery and mixer for mixing the solids concentrate and oil concentrate streams.

Orifice gallery 76 which consists of a series of orifice plates 50 sized to reduce the pressure in the solid concentrate to a predetermined amount is situated on solids concentrate line 68. Solids concentrate line 68 and oil concentrate line 43 each extend to oil/solids mixer 52 and oil/solids concentrate line 80 extends from mixer 52 upwards through end unit 46 to oil concentrate pump 20. As an alternative to orifice gallery 76 and mixer 52, a jet jump or eductor may be used to mix the solids concentrate and the oil concentrate. FIGS. 11, 12 and 13 show alternative arrangements using orifice gallery 76 and mixer 52, jet pump 90 and progressing cavity pump 92 respectively to mix the solids concentrate and the oil concentrate.

The threaded connections of end unit 32 of desander housing 44 incorporates lugs to provide torque resistance.

Figure 3:
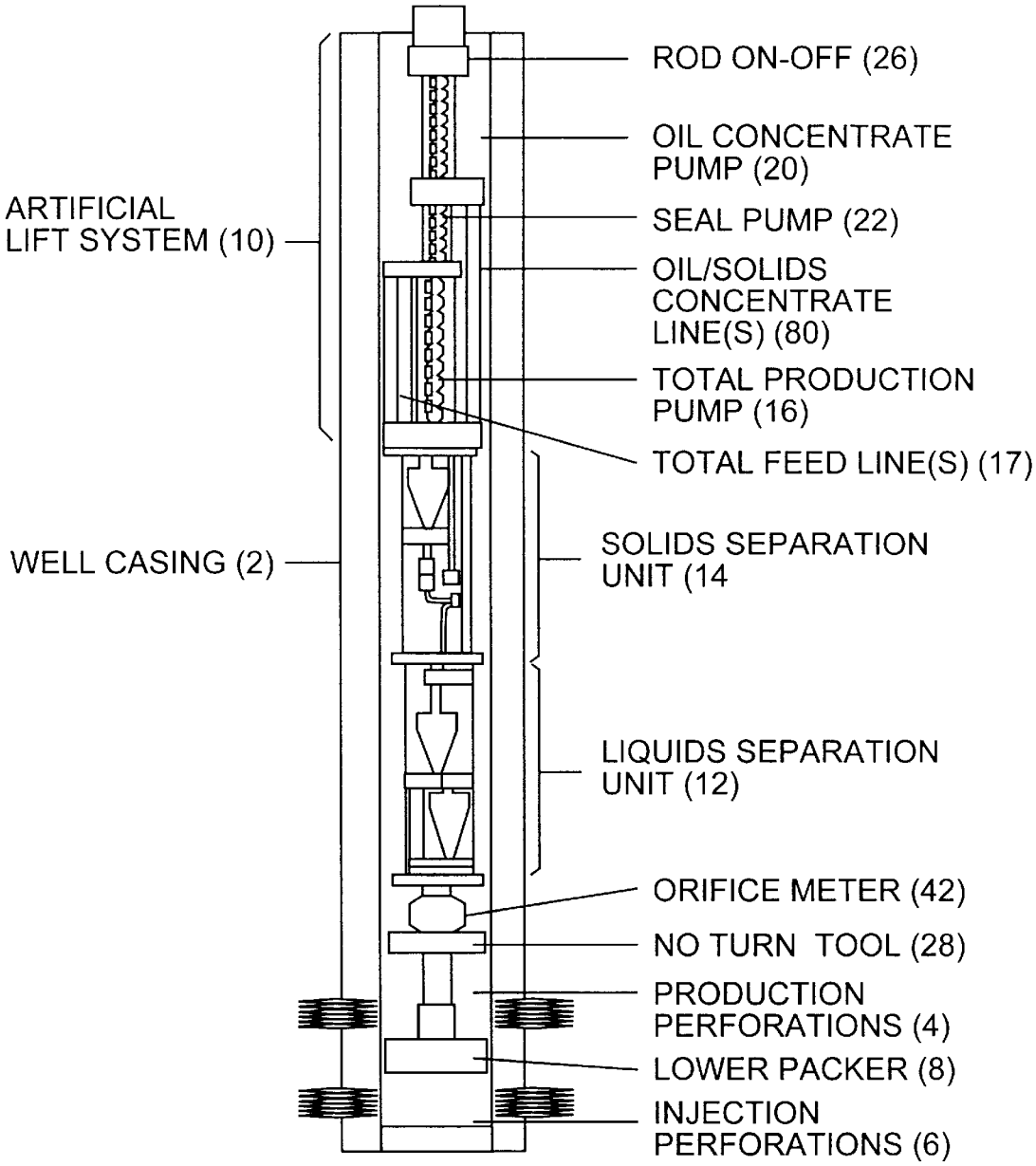
FIG. 3 is a schematic representation illustrating the process of the present invention.

The operation of the invention will now be described with reference to FIGS. 1, 2 and 3. It is to be noted that FIG. 3 is a simplified schematic only and does not illustrate all of the features shown in FIG. 1. Production fluid enters well casing 2 via production perforations 4. The fluid enters total fluid (emulsion) pump 16 through inlet screen 18 and is pumped into total fluid feed line 17. The fluid then enters chamber 60 and passes through axial flow passages 61 into inlet section annulus 62. The direction of flow of the liquid is changed from axial to tangential by flow diverter 64. The fluid then passes into cyclone 48 wherein a solids depleted stream consisting mostly of water and oil exits cyclone 48 via its overflow outlet and, being contained by housing 44, descends to the inlet of liquid/liquid cyclone 36. The solids enriched stream which normally contains high concentrations of sand, exits from the underflow outlet of cyclone 48 and passes through solids concentrate line 68 to mixer 52. The pressure of the stream is reduced as it passes through orifice gallery 76 so that the pressure matches the pressure of the oil concentrate stream with which it eventually commingles at mixer 52.

The solids depleted stream enters liquid/liquid cyclone 36 where it is separated into an oil concentrate stream and a water stream. The oil concentrate stream exits cyclone 36 (and 38 according to FIG. 2 which shows upper and lower cyclones) at the overflow outlet and is directed through oil concentrate line to mixer where it mixes with solid enriched stream. The mixed oil and solids stream is then transported through oil/solids concentrate line 80 to oil concentrate pump 20 and then pumped to surface. The water stream, now substantially free of solids, exits cyclone 36 through the underflow outlet and is reinjected into injection zone through injection perforations 6.

The separator system of the present invention can be used with either a push through or pull through DHOWS system. In pull through systems, the solid/liquid mixture is pulled through the solid/liquid hydrocyclone prior to entering the pump suction of the DHOWS system. These configurations are typically utilized when there is concern that boosting the pressure up to the injection pressure requirements of the DHOWS system, prior to passing the solid/liquid mixture through the solid/liquid hydrocyclone, could cause emulsions to form which cannot be separated within the solid/liquid and/or liquid/liquid hydrocyclones thus rendering the entire system inoperable. In push through systems, the solid/liquid mixture is passed through the DHOWS pumps prior to the solid/liquid hydrocyclone. This increases the solid/liquid mixture pressure to that required for water injection. Following the increase in pressure, the solid/liquid mixture is directed to the solid/liquid hydrocyclone for separation. Push through systems are typically utilized in situations where shearing the solid/liquid mixture in the DHOWS pumps prior to solid/liquid separation does not cause a concern of emulsions forming that cannot be readily separated in the solid/liquid hydrocyclone and/or liquid/liquid cyclone.

Figure 6:
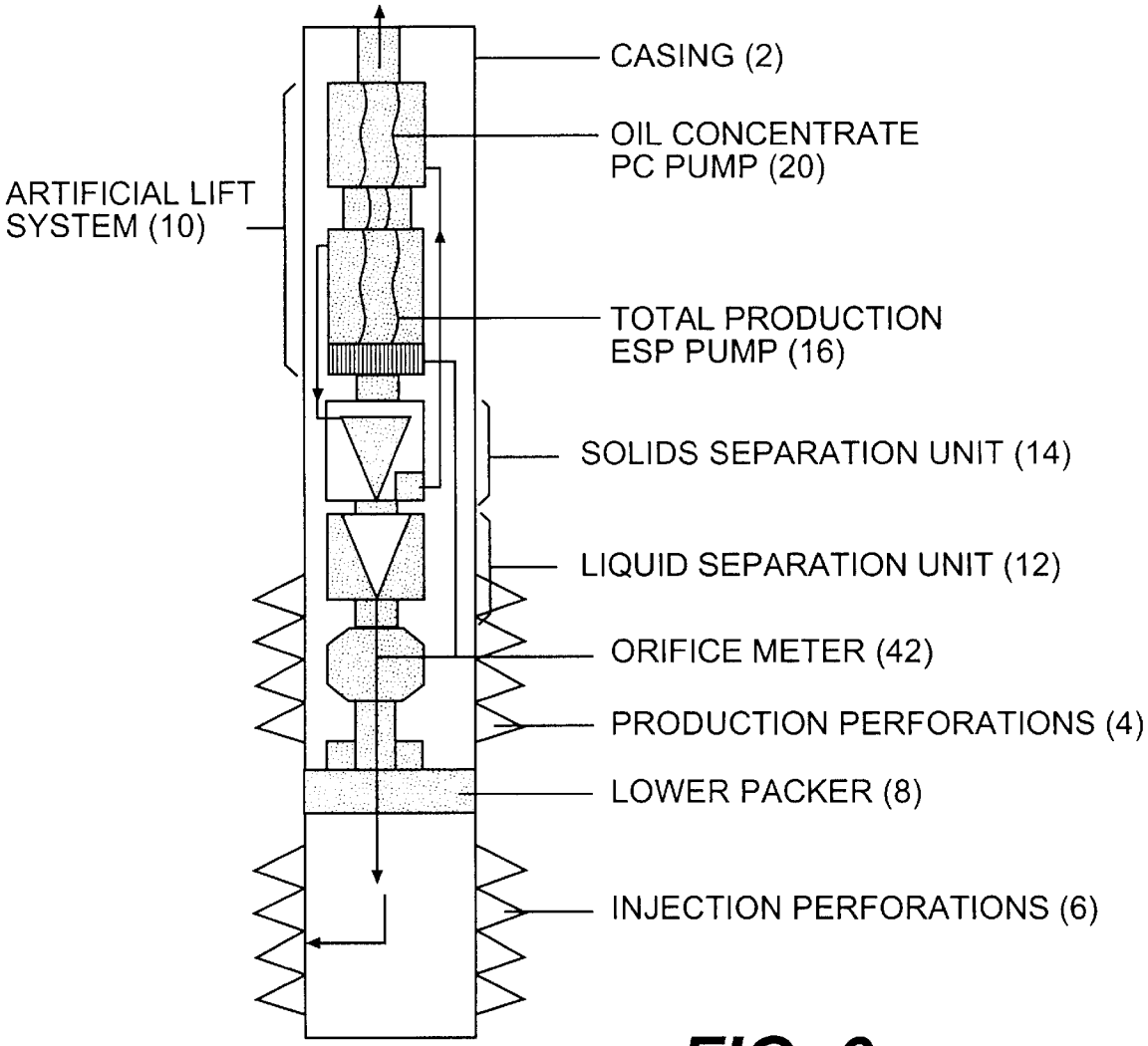
FIG. 6 is a longitudinal cross sectional view of the solids separation unit of the present invention with a progressing cavity pump in a push through flow configuration.
Figure 7:
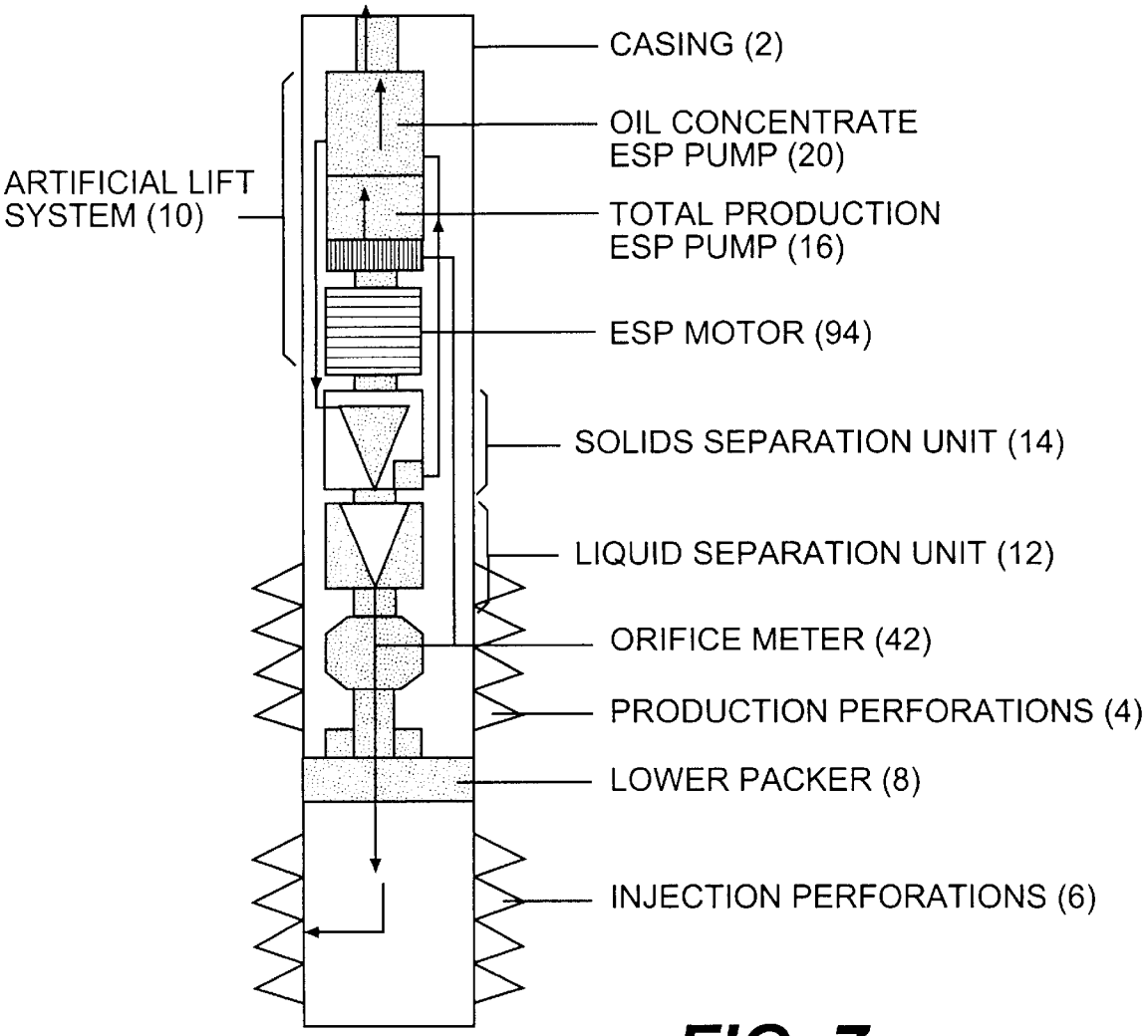
FIG. 7 is a longitudinal cross sectional view of the solids separation unit of the present invention with an electric submersible pump with a single shaft pump section in a push-through flow configuration.
Figure 8:
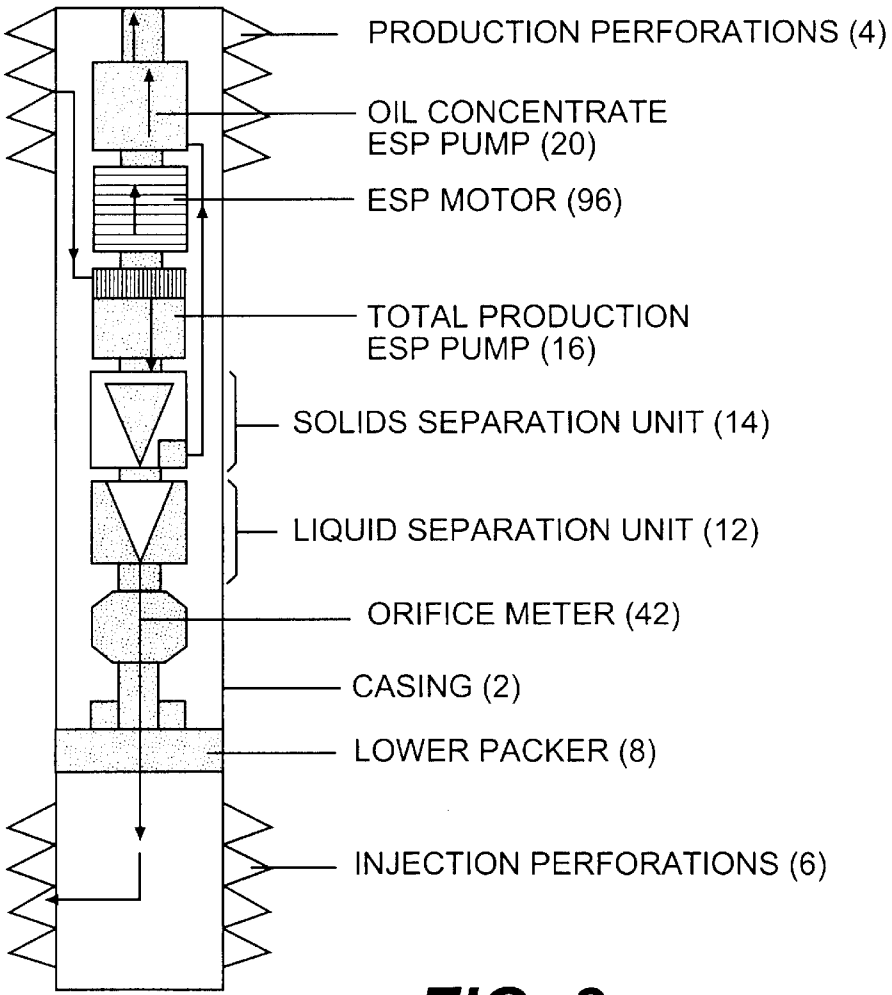
FIG. 8 is a longitudinal cross sectional view of the solids separation unit of the present invention with an electric submersible pump with a twin shaft pump section in a push-through flow configuration.
Figure 9:
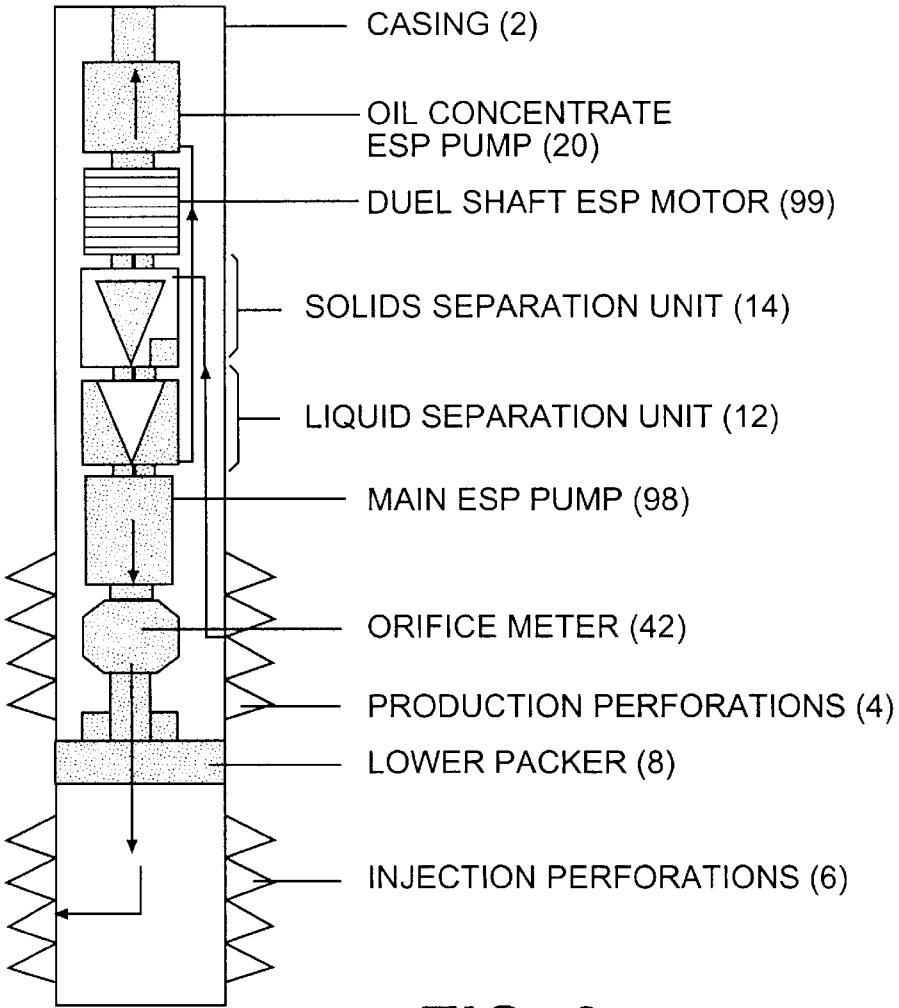
FIG. 9 is a longitudinal cross sectional view of the solids separation unit of the present invention with a high volume electric submersible pump with a twin shaft pump section in a pull-through flow configuration.
Figure 10:
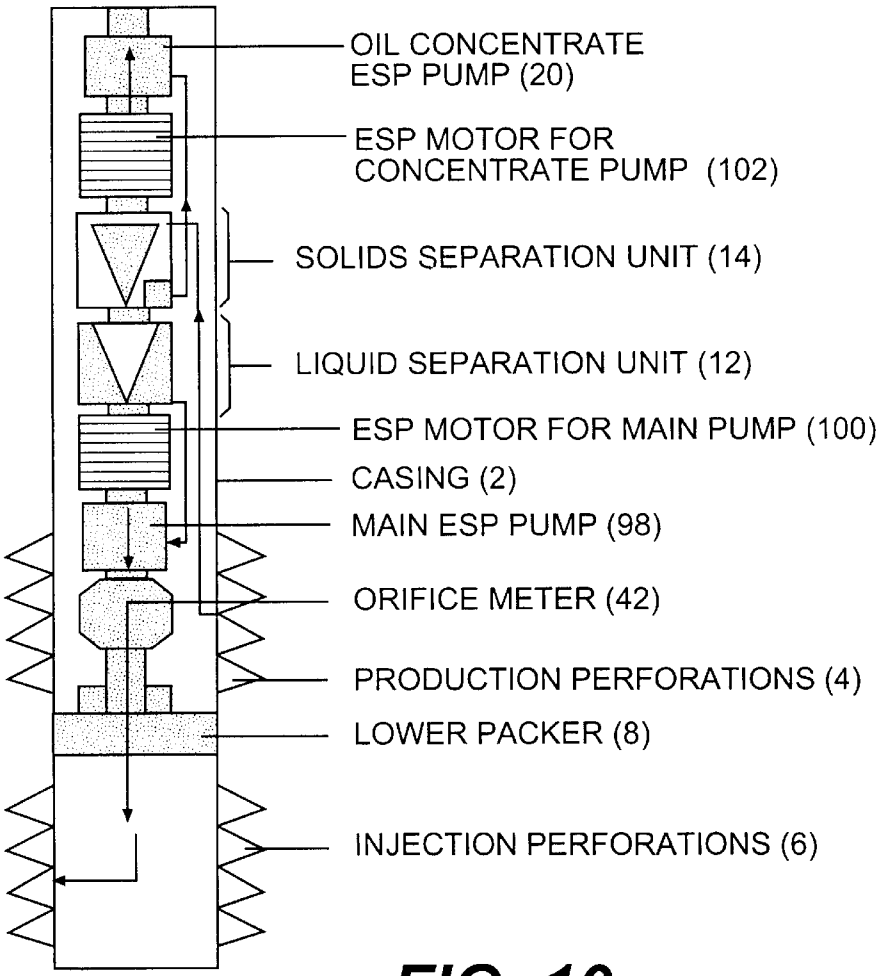
FIG. 10 is a longitudinal cross sectional view of the solids separation unit of the present invention with an electric submersible pump with a twin motor pump section in a pull-through flow configuration.

Referring now to FIG. 6, the solids separation unit of the present invention with a progressing cavity pump in a push through flow configuration is shown. FIG. 7 shows the solids separation unit of the present invention with an electric submersible motor 94 with a single shaft pump section in a push-through flow configuration. FIG. 8 shows the solids separation unit of the present invention with an electric submersible motor 96 with a twin shaft pump section in a push-through flow configuration. FIG. 9 shows the solids separation unit of the present invention with a high volume electric submersible 98 with a twin shaft motor section 99 in a pull-through flow configuration. FIG. 10 shows the solids separation unit of the present invention with an electric submersible motor 98 with a twin motor pump section 100,102 in a pull-through flow configuration;

EXAMPLE 1

The separation system of the present invention was tested in field trials conducted in a well of the Hayter Dina "Q" pool oil reservoir in Alberta, Canada. The reservoir is comprised of clean unconsolidated channel fill sands deposited in a fluvial to estuarine environment. The Hayter Dina "Q" pool is a heavy oil pool (14–16° API) with a large and very active water drive.

Figure 5:
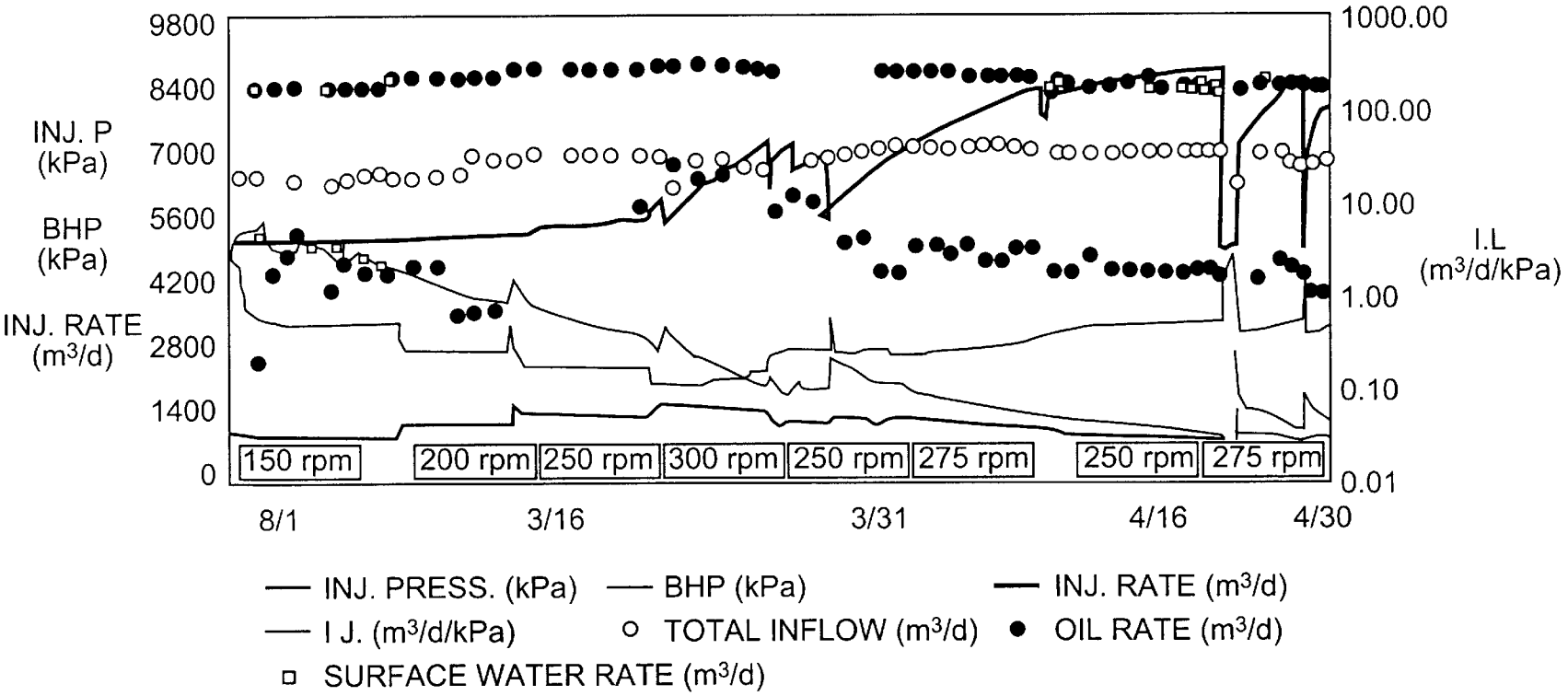
FIG. 5 is a graphical representation of downhole production and injection results for the DHOWS without solids separation system.

The well chosen had been previously used for testing of a DHOWS system without solids separation and had exhibited severe injection zone plugging. FIG. 5 shows a plot of the pressures and rates monitored during the previous operation of the conventional DHOWS system (without solids separation). The data shows that the injectivity began to decline shortly after the trial began, to the point where the injection pressure exceeded the rated pressure of the total flow pump. As a result, only limited drawdown of the well was achieved. At this low drawdown, the oil production remained below 2 $m^3$/d for the majority of the trial period.

In the field trial of the system of the present invention (DHOWS with solids separation), the well was equipped with a BMW Pump model 120–600 total fluid pump, a BMW Pump model 20–600 oil concentrate pump, and a BMW Pump model 4–600 seal pump. The solids separator was a single cyclone liner with a capacity of up to 400 $m^3$/d and up to 1% sand by volume. In preparation for installation of the DHOWS with solid separation system, the well bore was cleaned of sand using a sand bailer and a pump-to-surface tool. An injection test was performed to confirm the injection rate into the lower disposal zone. To operate the lower total emulsion pump at optimal efficiency and to inject the desired 200–250 $m^3$/d of water into the injection zone, an injectivity index of greater than or equal to 0.2 $m^3$/d/kPa was achieved.

A retrievable packer was set between the production and the injection intervals to isolate the zones. An extended seal assembly was chosen to allow axial tubing movement while maintaining annulus isolation. The system was installed in two sections. The first section consisted of the solids and liquid separation systems, instrumentation sub and no-turn tool. The pump intake, total fluid pump, sealing pump, concentrate production pump and rod on-off connector made-up the second section. Both sections were assembled on location and run into the well bore. The rod on-off connector consisted of a J-lock mechanism designed to allow the corod string to be disconnected from the rotor assembly. Following the running and landing of the downhole separation unit, a 25.4 mm corod string was run and latched on to the BMW 20–600 rotor assembly. A 60 hp electric wellhead drive was installed to operate the separation system from the surface.

The separation system was initially operated at a low pump speed (200 rpm). The speed was increased by 25 to 50 rpm every two weeks up to a final speed of 375 rpm.

Figure 4A:
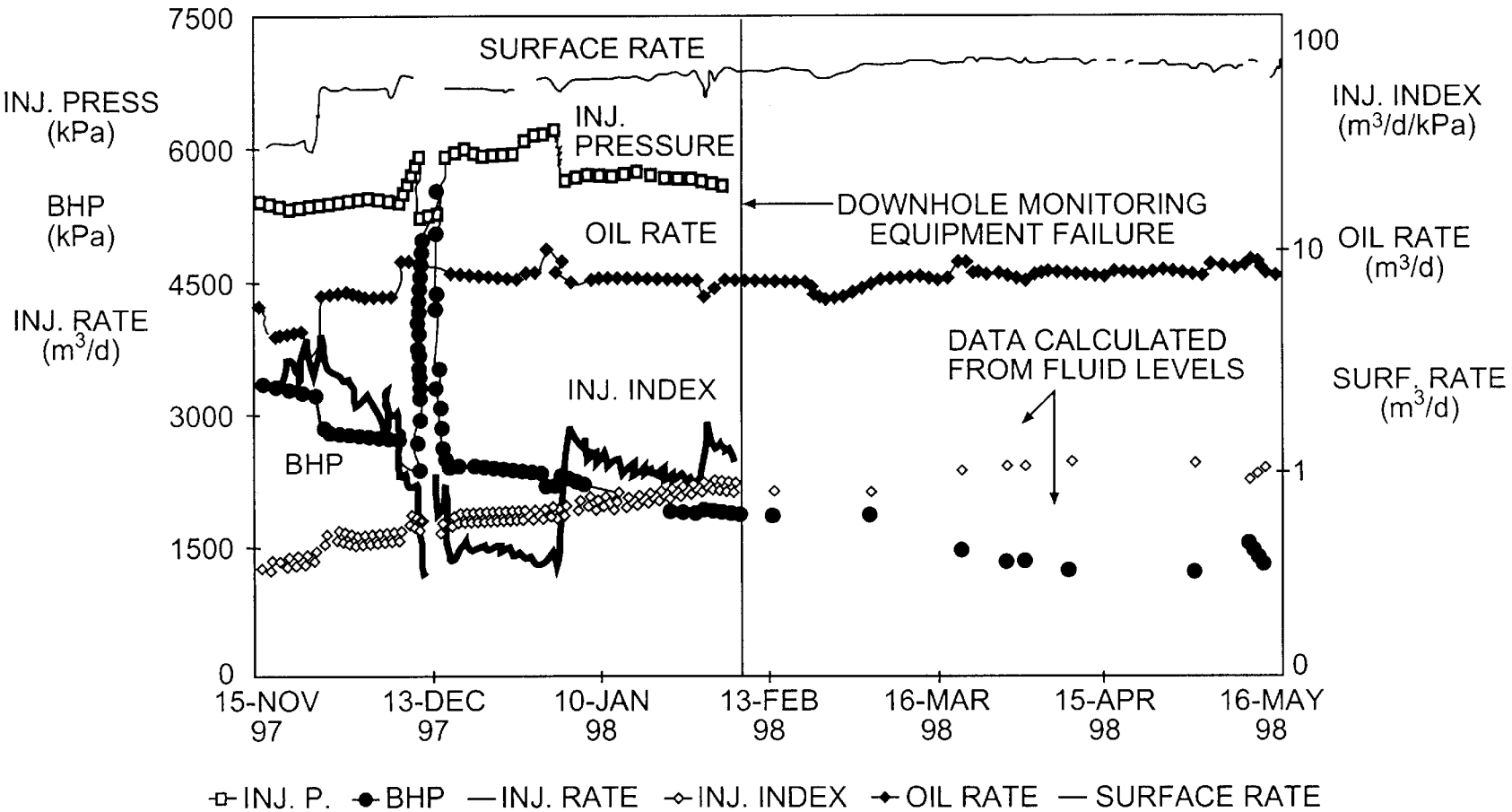
FIG. 4*a* and 4*b* is a graphical representation of downhole production and injection results for the DHOWS with solids separation system of the present invention.
Figure 4B:
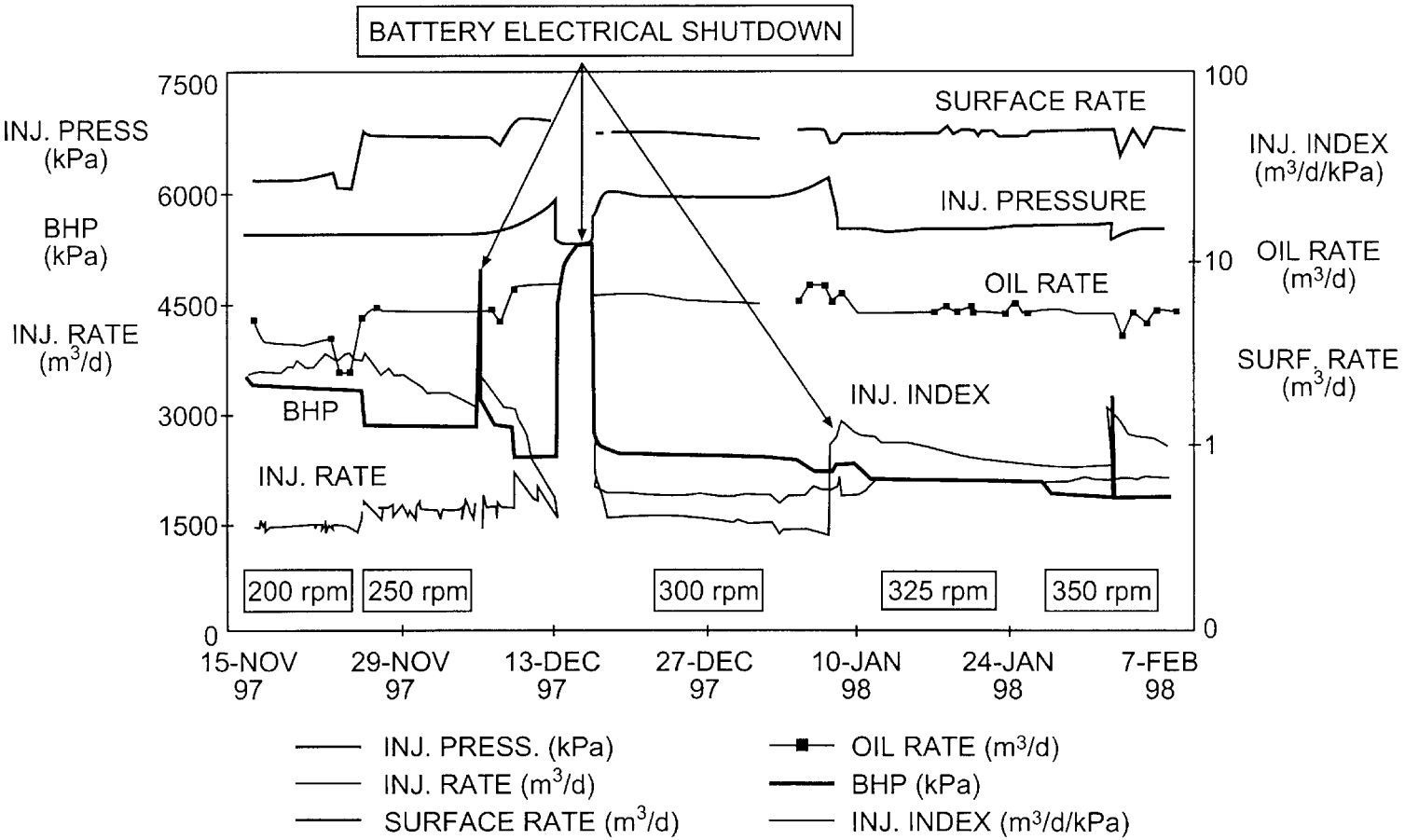

The performance results of the Hayter field trial are shown in FIGS. 4*a* and 4*b*. The results illustrate that the following:

(i) injectivity

The injectivity did not decline as a result of sand plugging as in the operation of the DHOWS without solids separation in the same well.

(ii) surface sand cuts

The surface sand cuts showed the presence of solids, ranging from 0.1% to 0.7% indicating that the separation system was effective.

(iii) improved drawdown

The system was successful in drawing down the well and maintaining oil rates above 6 $m^3$/d. The total volume of fluid produced to surface is 60 $m^3$/d with approximately 300 $m^3$/d of separated water injected into the lower disposal zone, indicated an 83% reduction in water to surface.

While the invention has been described with reference to certain embodiments, it is to be understood that the description is made only by way of example and that the invention is not to be limited to the particular embodiments described herein and that variations and modifications may be implemented without departing from the scope of the invention as defined in the claims hereinafter set out.

We claim:

1. A method for separating downhole oil well production fluid from a production zone of a subterranean formation, wherein said fluid contains oil, water and solids comprising:

(a) delivering the production fluid to a liquid/solid cyclone;

(b) separating the production fluid in the liquid/solid cyclone into a solids enriched stream at the cyclone underflow and a oil and water enriched stream at the cyclone overflow;

(c) delivering the oil and water enriched stream to a liquid/liquid cyclone; and (d) separating the oil and water enriched stream in the liquid/liquid cyclone into an oil enriched stream at the cyclone overflow and a water enriched stream at the cyclone underflow.

2. The method of claim 1 wherein the enriched water stream is reinjected into a downhole disposal site located either above or below the production zone.

3. The method of claim 1 wherein the oil enriched stream is delivered to surface.

4. The method of claim 1 wherein the solids enriched stream is delivered to surface.

5. The method of claim 1 wherein the oil enriched stream and the solids enriched stream are mixed downhole and said mixture is delivered to surface.

6. The method of claim 5 wherein a pressure reducing means reduces the pressure of the solid enriched stream to approximately equal to the pressure of the oil enriched stream prior to mixing said streams.

7. The method of claim 6 wherein the pressure reducing means is an orifice gallery.

8. The method of claim 5 wherein the oil enriched stream and the solid enriched stream are mixed by abet pump.

9. The method of claim 5 wherein the oil enriched stream and t he solid enriched stream are mixed by a progressing cavity pump.

10. A method for separating downhole oil well production fluid from a production zone of a subterranean formation, wherein said fluid contains oil, water and solids comprising:

(a) delivering the production fluid to a liquid/solid separator;

(b) separating the production fluid in the liquid/solid separator into a solids enriched stream and an oil and water enriched stream;

(c) delivering the oil and water enriched stream to a liquid/liquid cyclone separator; and (d) separating the oil and water enriched stream in the liquid/liquid cyclone separator into an oil enriched stream at the cyclone overflow and a water enriched stream at the cyclone underflow.

11. The method of claim 10 wherein the liquid/solid separator is a swirl inducer.

12. The method of claim 11 wherein the liquid/solid separator is a static auger.

13. An apparatus for separating oil well production fluid containing oil, water and solids downhole comprising:

(a) at least one liquid/solid cyclone adapted to receive the production fluid and separate it into a solid enriched stream at an underflow outlet of said cyclone and an oil and water enriched stream at the overflow outlet of said cyclone;

(b) at least one liquid/liquid cyclone adapted to receive the oil and water enriched stream as overflow from the liquid/solid cyclone and separate said stream into an oil enriched stream at an overflow outlet of said cyclone and a water enriched stream at an underflow outlet of said outlet;

(c) a mixing means to mix the oil enriched stream with the solids enriched stream and produce an oil/solids stream;

(d) a first duct means to transport the oil enriched stream from the underflow outlet of the liquid/liquid cyclone the mixing means;

(e) a second duct means to transport the solid enriched stream to the mixing means; and (f) a third duct means to transport the oil/solids stream to surface.

14. The apparatus of claim 9 wherein a solids accumulator provided is connected to the first duct means and the second means to receive solids draining from said duct means.

* * * * *